US006615425B1

(12) United States Patent
Candell

(10) Patent No.: US 6,615,425 B1
(45) Date of Patent: Sep. 9, 2003

(54) BOX FOUNDATION WITH INCLUDED DRAWERS

(76) Inventor: John A. Candell, 43643 Tonica Rd., Fremont, CA (US) 94539

( * ) Notice: Subject to any disclaimer, the term of this patent is extended or adjusted under 35 U.S.C. 154(b) by 0 days.

(21) Appl. No.: 10/234,491

(22) Filed: Sep. 3, 2002

(51) Int. Cl.[7] ..... A47C 19/22
(52) U.S. Cl. ..... 5/400; 5/308; 5/2.1
(58) Field of Search ..... 5/2.1, 58, 308, 5/400, 931

(56) References Cited

U.S. PATENT DOCUMENTS

| | | | | | |
|---|---|---|---|---|---|
| 152,357 | A | * | 6/1874 | French | 5/308 |
| 1,866,953 | A | * | 7/1932 | Stephens | 5/308 |
| 2,271,388 | A | | 1/1942 | Cohn | |
| 2,538,549 | A | | 1/1951 | Zuk | |
| 2,904,798 | A | | 9/1959 | Heflin | |
| 2,956,290 | A | * | 10/1960 | Scheinerman | 5/308 |
| 4,360,936 | A | * | 11/1982 | Keller | 5/9.1 |
| 4,617,689 | A | | 10/1986 | Nelson | |
| 4,662,015 | A | | 5/1987 | Golumbeck | |
| 5,099,529 | A | | 3/1992 | Anderson | |
| 5,701,653 | A | * | 12/1997 | Rupe | 29/432 |
| 6,292,960 | B1 | * | 9/2001 | Bowling | 5/308 |

FOREIGN PATENT DOCUMENTS

| | | | |
|---|---|---|---|
| GB | 2056268 | A | * 8/1979 |
| GB | 2076280 | A | * 12/1981 |

* cited by examiner

*Primary Examiner*—Michael F. Trettel
(74) *Attorney, Agent, or Firm*—Howard E. Lebowitz

(57) ABSTRACT

The invention is a foundation for a bed, either a box spring or a box foundation, with built-in drawers. The invention solves the problem of providing drawer storage space in a bed utilizing a mattress and foundation combination. Drawers are known to be placed under certain platform beds, however these beds do not readily accommodate a mattress with foundation, because such a combination places the mattress too high off of the floor for convenient use as a bed.

16 Claims, 6 Drawing Sheets

BOX FOUNDATION WITH INCLUDED DRAWERS

BACKGROUND OF THE INVENTION

1. Field of the Invention

This invention pertains to box springs or box foundations for use with a mattress and bed frame.

2. Description of the Prior Art

There is a well-known consumer desire to utilize space associated with a bed for useful storage of clothing and other possessions. There are many familiar manifestations of placing drawers under a bed that are in use today. For example, platform beds, where a mattress or futon rests directly on a solid wood platform or slats, are often built with drawers that are built into a framework under the platform. It is also known to make drawers or containers for placement on the floor under the platform in a platform bed. However, many bedding units sold today are of a combination type where a mattress rests on a box foundation or box spring that in turn rests on a bed frame of some sort. In these units the mattress is designed and intended to be supported on a box spring or foundation as opposed to being supported on an unyielding solid surface such as a platform or on the floor. Also, proper support leads to extended mattress lifetimes which are guaranteed by the manufacturers only if the mattress is properly supported. It is difficult to utilize drawers in the bed space area for this combination type arrangement because the bed frame designed for combination mattress-box foundation (or box spring) typically sits closer to the floor than mattress only units, leaving little room to fit drawers under the bed. A bed frame design is generally set by the desire that the top of the mattress be at a desired elevation that is often in the range of about 22 to 25 inches off the floor for standard consumer units. For this reason, it is typical that bed frames come to come in different models designed for use with or without a box foundation or box spring, wherein the box spring designs to do not leave much room for drawers underneath. The instant invention addresses the need for a convenient way to utilize drawers in a combination mattress and box foundation (or box spring) bed.

U.S. Pat. No. 2,271,388 to Cohn discloses a sectional bedspring comprising a resilient spring section connected with hinges to a non-resilient foot section having a storage compartment therein and a basket adapted to removably slide within the foot section.

U.S. Pat. No. 2,538,549 to Zuk discloses a bed comprising a spring unit supported thereon which is shortened at the foot end to provide a space for a drawer, a cover plate over the space, the cover plate aligned with the spring unit, a foot board with an opening therein, and a drawer mounted through the opening into the space.

U.S. Pat. No. 2,904,798 to Heflin discloses a hospital bed with a drawer mounted on the frame under the mattress.

U.S. Pat. No. 4,617,689 to Nelson, et al, discloses a knockdown platform bed for support of a mattress on the platform, wherein the platform support members are spaced to form compartments, the sideboards are ladder frames with the openings aligned with the compartments, and drawers are inserted through the openings into the compartments.

U.S. Pat. No. 4,662,015 to Galumbeck, discloses a combined foundation and bedspread bench for a bed, wherein the bedspread bench is supported on telescopic rail assemblies whereby the bench moves between a retracted position where it is folded into a compartment at the bottom foot end of the foundation and an extended position where it is available at the foot of the bed to hold a bedspread.

U.S. Pat. No. 5,099,529 to Anderson, discloses an adjustable bed frame assembly for support of mattresses and springs comprising two longitudinal units in spaced apart side by side relationship held apart by adjustable spacer members. The frame units define storage compartments for drawers as in Nelson.

The prior art demonstrates a number of approaches to including storage space. However, the prior art has limitations when it is desired to use the mattress-box spring or box foundation combination and make good use of the space occupied by the foundation. Important considerations are that the solution must fit into the existing bedding industry, the solution must be compatible both functionally and aesthetically with current standard mattresses.

There is a need for an adaptation of box springs or box foundations that can be used with conventional mattresses while allowing the convenient use of drawers for storage.

SUMMARY OF THE INVENTION

The invention pertains to mattress foundations, namely box springs and box foundations, which incorporate built in drawers. A box foundation with built in drawers comprises a framework including a top support frame, a bottom support frame, and a plurality of intermediate support members that support the top frame on the bottom frame. The intermediate support members define open spaces that can accommodate drawers. The box foundation further comprises one or more drawers each inserted in one of the open spaces. The drawers and framework have a cover.

A box spring with built-in drawers is a box foundation as previously described with a multiplicity of springs attached to the top support frame, occupying a space between the top support frame and the cover.

A box spring or a box foundation according to the invention is sized to support a mattress, usually a mattress of one of the familiar classifications, such as twin, twin extra long, full, king, or queen. It has an appearance similar to conventional bedding such as a counterpart without drawers, except for the drawers. It is used in the same manner with the drawers being available for storage. It is approximately the same thickness as conventional foundations.

The invention solves the problem of providing usable storage space in beds where a mattress and foundation are used in combination. It is known to place drawers under the platform in platform beds, however these beds do not readily accommodate a box foundation or box spring because they would place the mattress too high off of the floor. Bed frames for mattress with foundation beds sit closer to the floor than platform beds which can accommodate drawers. The invention solves the problem by incorporating the drawers into the foundation while still providing support for the mattress.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENTS

Figure 1:
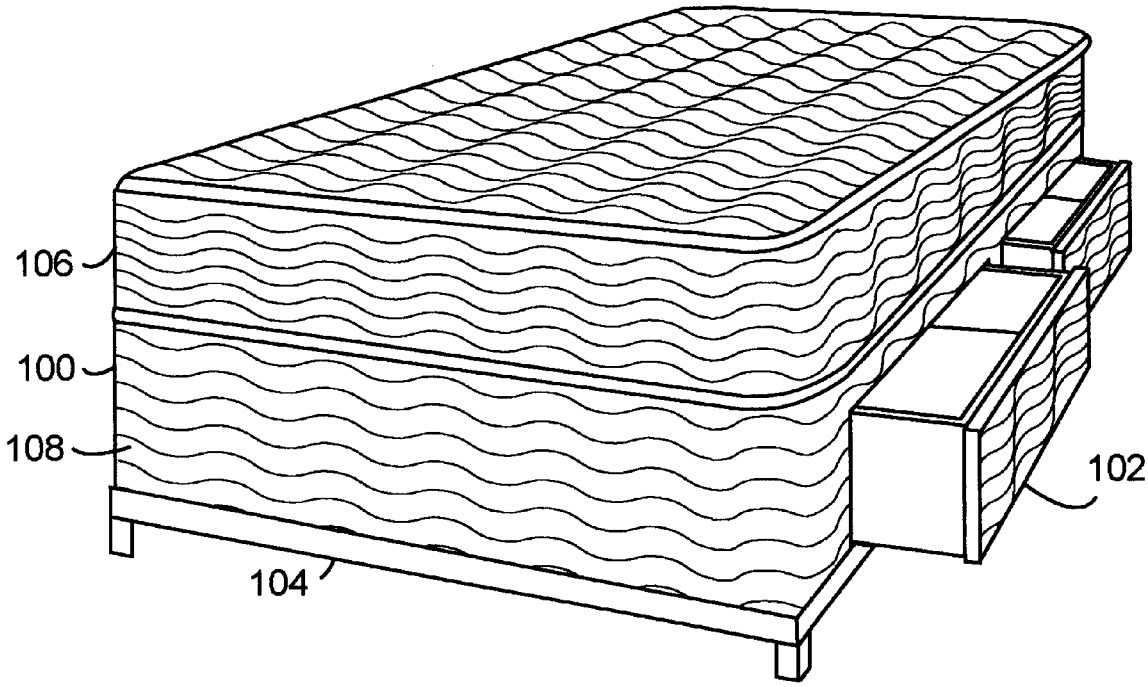
FIG. 1 is a drawing of a box foundation for a twin bed having two drawers.

Preferred embodiments of the invention are a new type a box foundation and a new box spring for use as mattress supports. The improvement involves incorporation of drawers in either a box foundation or box spring unit. As used herein a box spring a bedspring that comprises springs attached to a foundation and enclosed in a cover. The foundation of a box spring is usually a wood frame, but could be metal. The cover is usually a fabric, often a quilt type multi-layer design with a fabric outer cover and a layer of foam or other bedding material. A box foundation is a framework comprising an upper support frame with slats for supporting a mattress, and a box shaped framework supporting the upper support frame, the entire framework enclosed in a cover. A box foundation is usually made of a wooden framework enclosed in a cloth cover, usually a quilt cover. Both of these devices are in very popular use today for beds. Many mattresses, such as inner spring mattresses or advanced foam memory mattresses are specifically designed to be supported by a box spring or box foundation. The box spring or foundation serves several important functions including the following:

1. extending the mattress life as compared to putting the mattress directly on a solid surface such as a floor or an unyielding platform, by absorbing the shock involved with entering or exiting the mattress or moving;
2. improving comfort by absorbing shock;
3. ensuring a smooth constant surface so the mattress does not sag; and
4. bringing the overall height of the mattress to the desired level—a typical height is between about 22 and 25 inches, including a mattress, box spring or foundation, and bed frame. Mattresses and bed spring/foundations are typically in the range of eight to ten inches thick and the bed frame typically places the mattress four to seven inches off the ground.

An extremely popular bedding set up is an inner coil mattress, a matching box spring or foundation, and an adjustable metal bed frame. An inner coil mattress is a mattress having springs, usually coil springs, between layers of bedding material such as foam. The mattress and box spring are generally sold together as a matching pair.

Platform beds have assumed increasing popularity in large part because of the ability to utilize the space under the platform for shelves or drawers. A plethora of different styles are available where a mattress is supported on a platform that is typically wood. Often there are built in drawers under the platform, though some units have matching drawers that are simply placed on the floor under the platform. Platform beds are not made for use with a mattress-box spring/foundation combination because they are higher off the ground than the typical bed frame and a mattress and box spring/foundation will place the mattress too high off the ground for the typical consumer.

The instant invention satisfies what is missing in the prior art by building drawers into the foundation. There are two principal embodiments of the invention a box foundation with built in drawers and a box spring with built in drawers. Preferred properties for either embodiment are as follows:

1. The box spring/foundation with built in drawers should be built to match the length and width of the mattress. Mattresses are typically made to standard sizes, such as twin, full, queen and king, though they may also be made to custom sizes. It is important that the box/spring foundation with drawers match the mattress dimensions that it is intended to support.
2. The box/spring foundation should have the appearance of a conventional mattress foundation, except for the drawers. For example, the familiar cloth type covering of mattress and foundation.
3. The box/spring foundation should have a thickness which is similar to popular models of conventional foundations, about 8 to 10 inches.
4. The layout of the framework in the box/spring foundation should be compatible with accommodating the desired drawers in the sides.

Preferred dimensions of box spring/foundations with drawers built in are as follows:

| | Length × Width | Thickness |
|---|---|---|
| Twin | 38 × 74 inches | 10 inches |
| Twin (extra long) | 38 × 79 inches | 10 inches |
| Full | 53 × 74 inches | 10 inches |
| Queen | 59.5 × 79 inches | 10 inches |
| California King (split) | 35.5 × 83 inches | 10 inches |

FIG. 1 is a drawing of a box foundation 100 with two drawers 102 on a metal bed frame 104 supporting a mattress 106. A cover 108 encloses the internals of the box foundation. Note that except for the drawers, the unit has the appearance of an ordinary mattress and foundation.

Figure 2:
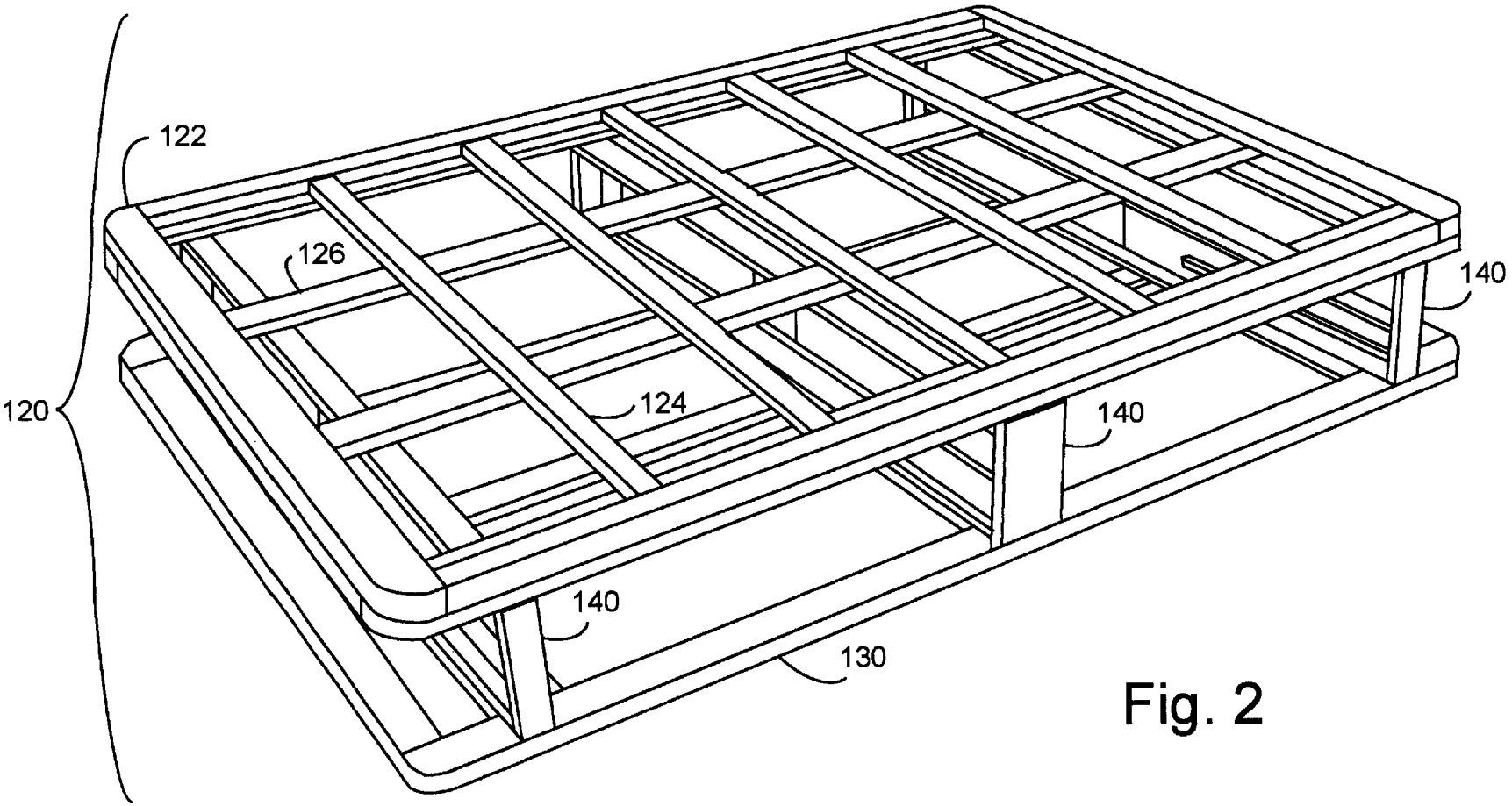
FIG. 2 is a drawing of a framework for a box foundation.

FIG. 2 is a drawing showing a framework 120 for a box foundation. The framework comprises a top support frame 122 having slats 124 substantially parallel to the width of the framework and perpendicular slats 126 substantially parallel to the length of the framework. The framework further comprises a bottom support frame 130 and three intermediate support members 140 that support the top support frame on the bottom support frame. Note that there are large spaces in the framework to accommodate drawers between the intermediate support members. Two drawers could be accommodated on either of the sides of the framework effectively utilizing the space within the foundation.

Figure 3:
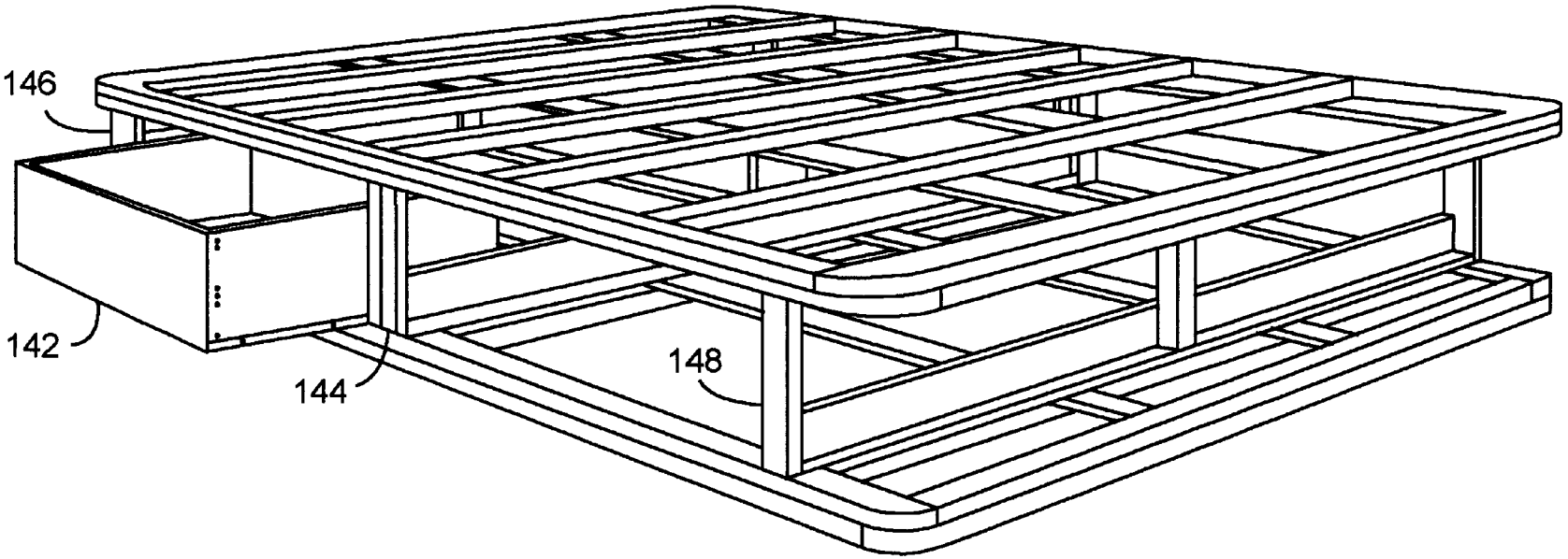
FIG. 3 is a drawing of a first embodiment of a framework with a drawer inserted.

FIG. 3 is a drawing showing a first preferred embodiment of a framework with a drawer 142 inserted in the space between the central intermediate support 144 and the left end support 146. A second drawer will be inserted between the central intermediate support 144 and the right end support 148. Note that the width of the two drawers occupies nearly the entire length of the framework in this preferred embodiment.

Figure 4:
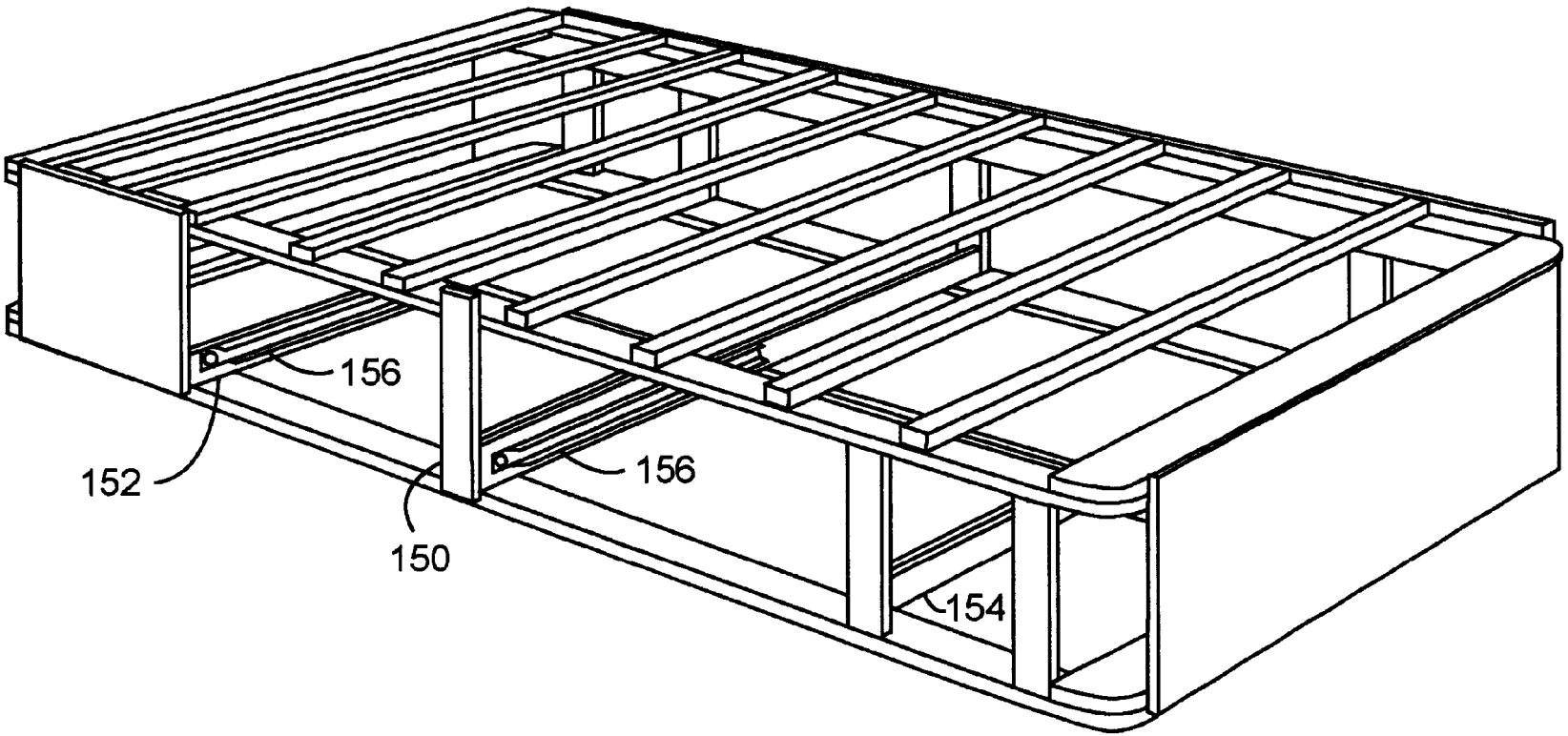
FIG. 4 is a drawing of a second embodiment of a framework.

FIG. 4 is a drawing showing a second preferred embodiment of a framework, having spaces for drawers between the central intermediate support 150 and a left drawer support 152 and a right drawer support 154. Note that this embodiment is compatible with drawers with smaller width than the first preferred embodiment shown in FIG. 3. Note also runners 156 that are mounted on the drawer supports and the central intermediate support. The drawers have compatible slides or rollers so that the drawers will slide in and out smoothly. Runners and slides or rollers are preferred in all the embodiments of the invention and may also have the reverse configuration with the runner on the drawer and the roller on the framework.

Figure 5:
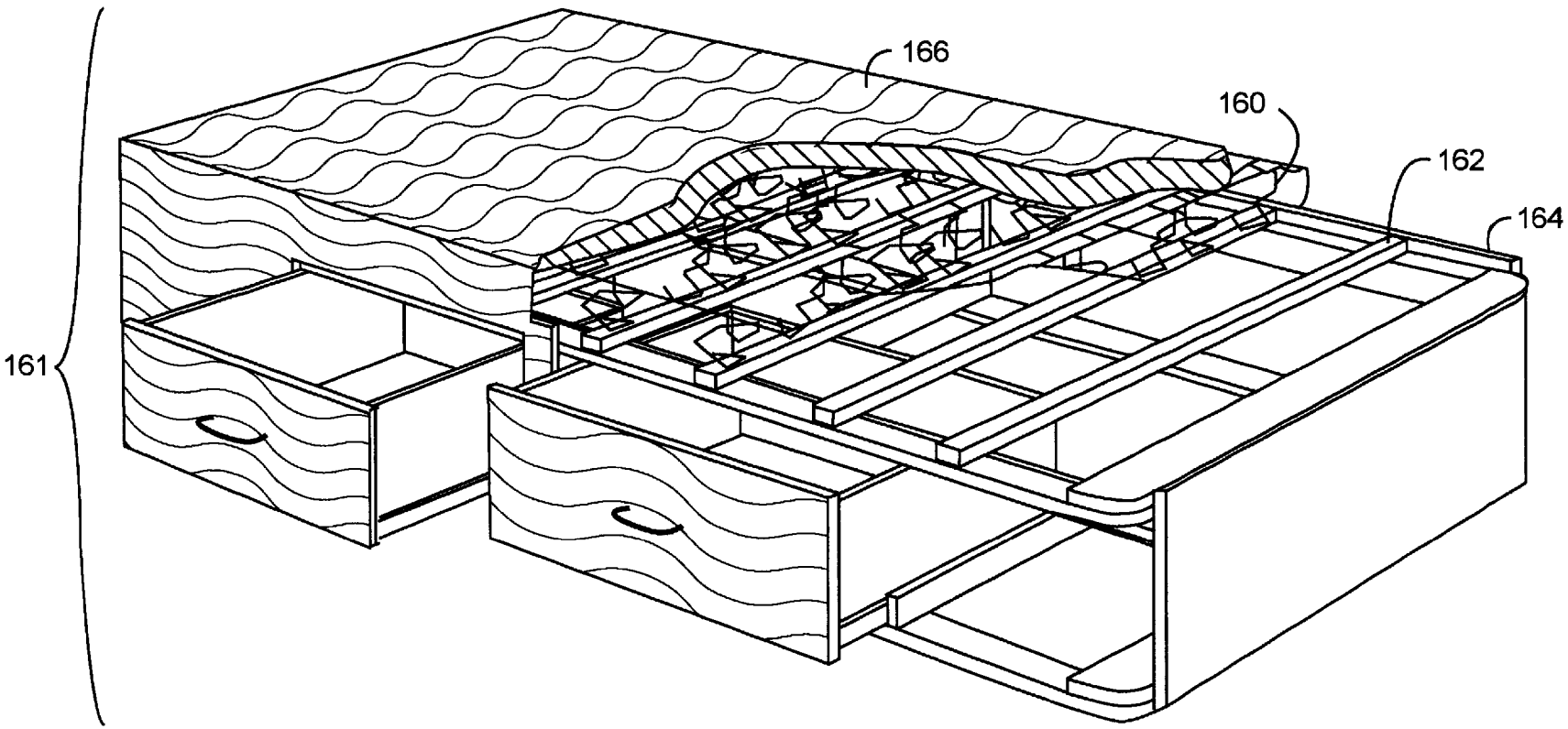
FIG. 5 is a cutaway drawing of a box spring with drawers using torsion springs.
Figure 6A:
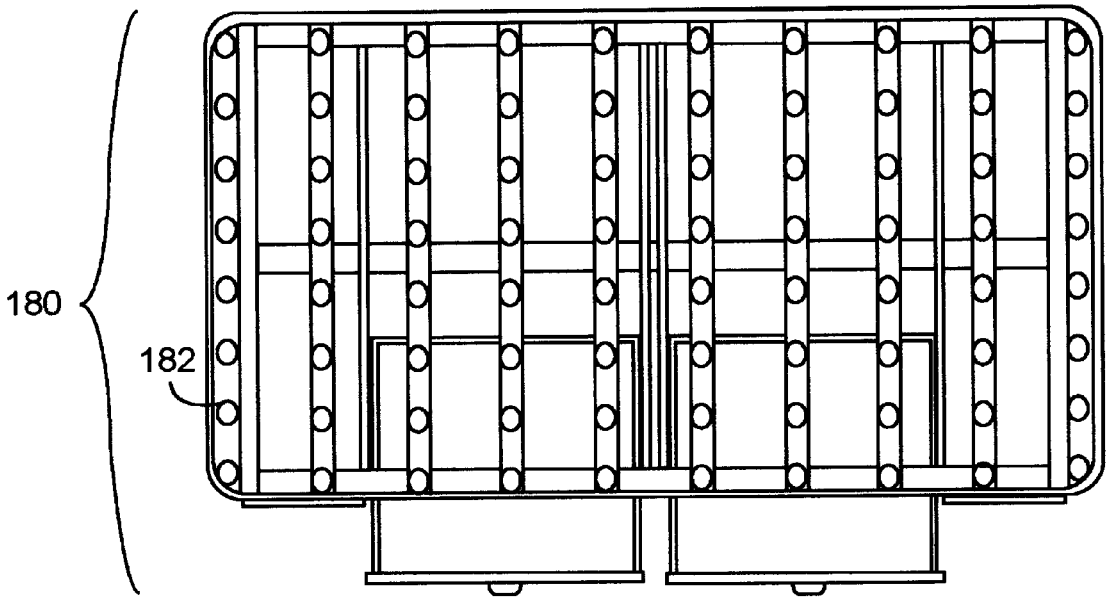
FIGS. 6A, 6B, and 6C are respectively top, front, and side drawings of a box spring using coil springs.
Figure 6B:
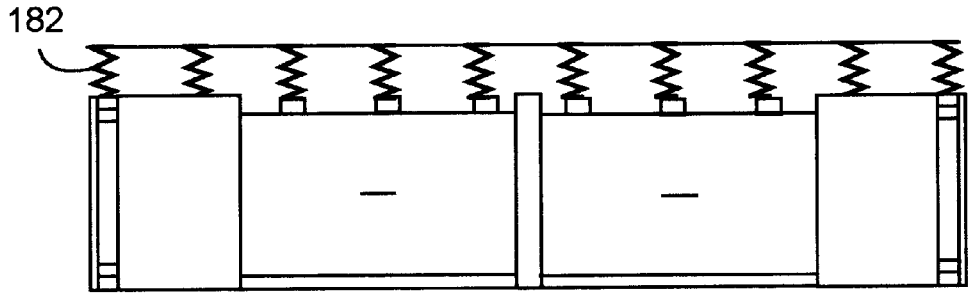
Figure 6C:
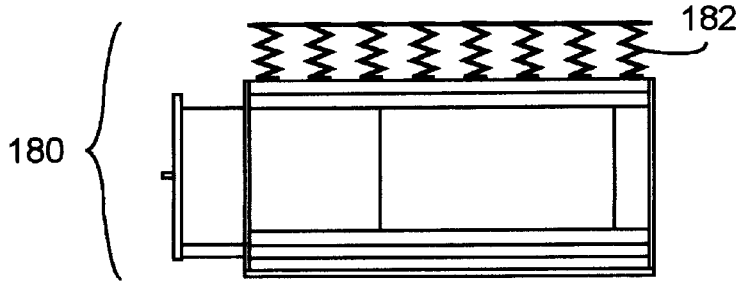

FIG. 5 is a drawing showing a preferred embodiment of the invention as a box spring 161, comprising springs 160 supported by the slats 162 which run across the width of the framework between the top support of the framework 164 and the cover 166. The springs 160 shown are compact torsion springs that are available in compact sizes. FIG. 6 shows a similar unit 180 with Bonnell coil springs 182. Note that box springs according to the invention are different from conventional design which would have springs attached to a frame similar to the top support in FIG. 5 or 6 without a framework comprising top and bottom support frames and intermediate support members. In the instant invention the framework serves to provide the open spaces for the drawers, while springs are above the framework. It is preferred to use compact springs for these for the box spring option having a spring height of about three inches. These springs are readily available commercially and are used in low profile box springs. The height available for a drawer is about four to about five inches allowing for the thickness of the springs, the cover and the top and bottom support frames.

A preferred configuration is to include two drawers on a twin bed or each module of a split bed. For full or queen foundations a preferred configuration is two drawers on each side of the bed.

It is preferred to make the framework from wood boards, though metal construction is possible. It is preferred to make the cover from fabric with a layer of foam or other bedding material between the springs (or the framework in the case of a box foundation) and the fabric cover. A thin coating with cardboard or other thin wood covering the springs or slats is preferred.

The construction of the framework and covering is conventional and win be well known to those skilled in the art from the description and drawings included herein.

The box spring with built in drawers or box foundation with built in drawers is used to support a mattress in the manner of their counterparts without drawers. The drawers are available for storage.

A preferred embodiment is a bed comprising a mattress, a box foundation or box spring with built in drawers, and a metal bed frame.

The use of a box foundation or box spring with built in drawers is a method of providing drawer space under a mattress while using a foundation.

Although the present invention has been described in considerable detail with reference to certain preferred versions thereof, other versions are possible. Therefore the spirit and scope of the appended claims should not be limited to the preferred versions herein.

What is claimed is:

1. A box foundation for support of a mattress comprising:

a) a framework, the framework comprising, i) a top support frame comprising a plurality of slats parallel to the width of the framework, ii) a plurality of intermediate support members, and iii) a bottom support frame, wherein the plurality of intermediate support members support the top support frame on the bottom support frame and define a plurality of open spaces on the sides of the framework, each open space being defined by adjacent intermediate support members, and wherein the framework is sized to fit under the mattress;

b) at least one drawer, said at least one drawer located in one of the plurality of open spaces; and c) a cover, the cover covering the framework and the at least one drawer, wherein said box foundation is constructed to fit under the mattress and match the appearance of the mattress and fit onto a bed frame.

2. The box foundation of claim 1, wherein the mattress is a standard size mattress, the standard size being chosen from the group consisting of twin, twin extra long, full, queen, California king, split California king, eastern king and split eastern king.

3. The box foundation of claim 2 wherein the standard size is either twin or twin extra long and the at least one drawer comprises two drawers.

4. The box foundation of claim 2 wherein the standard size is chosen from the group consisting of full, queen, California king, and eastern king and the at least one drawer comprises four drawers.

5. The box foundation of claim 4 wherein the four drawers comprise two drawers each on both sides of the box foundation.

6. The box foundation of claim 2 wherein the standard size is split California king comprised of two abutting sections, wherein each section comprises two drawers.

7. A box spring for support of a mattress comprising:

a) a framework, the framework comprising, i) a top support frame comprising a plurality of slats parallel to the width of said framework, ii) a plurality of intermediate support members, and iii) a bottom support frame, wherein the plurality of intermediate support members support the top support frame on the bottom support frame and define a plurality of open spaces on the sides of the framework, each open space being defined by adjacent intermediate support members, wherein said framework is sized to fit under the mattress and support the mattress and onto a bed frame;

b) a multiplicity of springs, each of said multiplicity of springs being attached to one of the plurality of slats;

c) at least one drawer, said at least one drawer located in one of the plurality of open spaces; and d) a cover, covering the framework, the at least one drawer and the multiplicity of springs, wherein said box spring is constructed to fit under the mattress, support the mattress, and fit onto the bed frame.

8. The box spring of claim 7, wherein the box spring is constructed according to a standard size, the standard size being chosen from the group consisting of twin, twin extra long, full, queen, California king, split California king, eastern king and split eastern king.

9. The box spring of claim 8 wherein the standard size is either twin or twin extra long and the at least one drawer comprises two drawers.

10. The box spring of claim 8 wherein the standard size is chosen from the group consisting of full, queen, California king, and eastern king and the at least one drawer comprises four drawers.

11. The box spring of claim 10 wherein the four drawers comprise two drawers each on both sides of the box foundation.

12. The box spring of claim 8 wherein the standard size is split California king comprised of two abutting sections, wherein each section comprises two drawers.

13. A bed comprising:

a) a mattress;

b) a foundation, the foundation comprising i) a framework, the framework comprising a top support frame comprising a plurality of slats parallel to the width of the framework, a plurality of intermediate support members, and a bottom support frame, wherein the plurality of intermediate support members support the top support frame on the bottom support frame and define a plurality of open spaces on the sides of the framework, each open space being defined by adjacent intermediate support members, ii) at least one drawer, said at least one drawer located in one of the plurality of open spaces, and iii) a cover, the cover covering the foundation; and c) a bed frame, wherein the foundation is constructed to fit under the mattress, to support the mattress, and to fit onto the bed frame.

14. The bed of claim 13 wherein the foundation further comprises a multiplicity of springs, each of said multiplicity of springs being attached to one of the plurality of slats.

15. A method of making a foundation for a mattress comprising the acts of:

a) constructing a framework the framework comprising a top support frame comprising a plurality of slats, a bottom support frame, and a plurality of intermediate support members, wherein said plurality of intermediate support members support the top frame on the bottom frame and define a plurality of open spaces on the sides of the framework, and wherein the framework is sized to fit under the mattress and support the mattress and onto a bed frame;

b) placing at least one drawer in one of the plurality of open spaces; and c) attaching a cover on the framework and the at least one drawer.

16. The method of claim 15 further comprising the act of attaching a plurality of springs to the plurality of slats on the top support frame before attaching the cover to the framework.

* * * * *